US005647419A

United States Patent [19]

Stewart

[11] Patent Number: 5,647,419

[45] Date of Patent: Jul. 15, 1997

[54] CUTTERHEAD INSERTS FOR AN INDUSTRIAL WOODWORKING MACHINE

[76] Inventor: John S. Stewart, 6921 Charnel La., Climax, N.C. 27233

[21] Appl. No.: 588,461

[22] Filed: Jan. 18, 1996

[51] Int. Cl.[6] ..... B27C 1/00; B27G 13/10

[52] U.S. Cl. ..... 144/230; 144/117.1; 144/218; 407/46; 407/47

[58] Field of Search ..... 144/117.1, 221, 144/229, 230, 231, 241; 407/45, 46, 40, 41, 47, 48, 101, 102, 103, 51

[56] References Cited

U.S. PATENT DOCUMENTS

| | | | |
|---|---|---|---|
| 4,074,737 | 2/1978 | Stewart | 144/117 |
| 4,830,073 | 5/1989 | De Abreu | 407/46 |
| 5,002,104 | 3/1991 | Stewart | 144/230 |
| 5,054,703 | 10/1991 | Morey | 407/47 |
| 5,183,089 | 2/1993 | Norlander et al. | 407/46 |
| 5,211,212 | 5/1993 | Carlson et al. | 407/48 |

*Primary Examiner*—W. Donald Bray
*Attorney, Agent, or Firm*—Rhodes Coats & Bennett, L.L.P.

[57] ABSTRACT

A cutterhead for an industrial woodworking machine comprising a cutterhead body having a cylindrical outer surface with at least one insert-receiving groove extending into the body from the outer surface; at least one cutting insert secured in the groove, the insert being comprised of an insert body, a blade attachment gib, and at least one detachable blade, each blade being secured adjacent the insert body by the blade attachment gib. The upper end of the gib preferably projects above the cutterhead body and is adapted to turn chips from the blades, which project above the attachment gib. Fasteners secure the blades between the body and the attachment gib, and the insert in the groove.

28 Claims, 2 Drawing Sheets

CUTTERHEAD INSERTS FOR AN INDUSTRIAL WOODWORKING MACHINE

BACKGROUND OF THE INVENTION (1) Field of the Invention

The present invention relates generally to rotary cutter heads for industrial wood working machines, more particularly, to improved cutting inserts for use in cutterheads for peripheral milling machines, including high speed planers and molders.

(2) Description of the Prior Art

Historically, rotary cutterheads used in industrial wood working machines, such as high speed planers, have been characterized by designs having straight, high speed steel knives clamped in the cutterhead body. More recently, stagger tooth arrangements for noise reduction and cutterheads with large numbers of knife rows for increased feed rates without increased RPM's have been introduced. The clamped-in-place solid knife design does not lend itself to the use of tool material other than high speed steel, because the replacement of knives is often tedious and costly. In addition to limitations on the types of cutting materials that can be used, there are also limitations on the ability to adjust the position of the cutting blades to meet different machining requirements.

U.S. Pat. No. 5,002,104 issued to John S. Stewart, the present inventor, the patent being incorporated herein by reference in its entirety, describes improved cutterheads with a sufficient number of knife rows to permit a staggered tooth arrangement for noise reduction or, alternatively, to provide an improved surface finish at higher feed rates without increasing cutterhead RPM, and provides for the generation of a variety of shapes when used with appropriately shaped individual cutting inserts.

The cutterhead described in the above patent is comprised of a cutterhead body and a plurality of removable cutting inserts attached to the body. The cutterhead body comprises a cylindrical portion having a plurality of circumferentially spaced grooves extending into the cutterhead body from the periphery thereof, which are adapted to receive the cutting inserts. A portion of the side walls of each groove is inwardly converging to substantially equally divide the forces exerted by the removable cutting insert between groove side walls, substantially reducing the circumferential spacing required between adjacent grooves.

Each of the cutting inserts used with the above cutterhead body includes a generally parallelepiped body having a blade aligned along its forward upper edge and a gullet portion aligned along its rear edge. Elongated slots in the body permit lateral adjustment along the axis of the cutterhead. The blade, which may be brazed on, mechanically fastened, or welded onto the insert body, has a generally L-shaped cross section, with an angular cutting edge for engaging the wood being cut, and a shoulder projecting below and in front of the blade to receive and assist in turning of chips in cooperation with the gullet of an adjacent cutting insert.

Individual cutting inserts in the above cutterhead can be replaced if broken or have otherwise reached the end of their useful life by exchanging the old cutting insert with a new cutting insert, thereby reducing the number of cutterheads required for a particular operation. The removed cutting insert can then be discarded or retipped with new cutting material. Alternately, worn inserts can be reground, either individually or in the assembled cutterhead. The new or reground inserts can be precisely installed and adjusted in the cutterhead body either on or off the machine.

While the foregoing cutterhead is a significant improvement over earlier cutterheads, further improvements are still desirable. For example, replacement of cutting inserts in the above-described cutterhead of U.S. Pat. No. 5,002,104 requires that the entire insert be replaced and the blade retipped. While this procedure is a substantial improvement over replacing solid, full-length cutterhead knives in the field, further convenience and savings are desirable. The current commercially feasible manner of attaching the blade to the cutting insert body, as shown in the U.S. Pat. No. 5,002,104 patent, is to braze or weld the blade onto the body, resulting in cutting blades that are difficult and expensive to refurbish, requiring extensive tool shop capabilities.

Therefore, it is a primary object of the present invention to provide an improved cutting insert having blades, which form the cutting edge, that can be quickly and economically replaced in the field. It is a further object of the invention to provide cutting inserts having blades that will withstand high impacts without damage due to elimination of brazing stresses. Another object of the invention is to provide a cutting insert structure permitting a wider use of cutting edge materials to meet various requirements. It is yet another object of the present invention to provide improved cutting inserts for cutterheads having these improvements.

SUMMARY OF THE INVENTION

The present invention is directed to improved cutterheads and to removable cutting inserts utilizable in cutterheads for an industrial woodworking machine, such as high speed planers and molders. These cutterheads include a generally cylindrical body secured onto a rotatable shaft by a locking means. The body contains a plurality of normally circumferentially spaced insert-receiving grooves extending into the cutterhead body from the outer surface. A plurality of cutting inserts are secured within the grooves.

The cutting inserts, to be described in detail hereinafter, have side walls that mate with complementary angled side walls of the grooves, thereby producing a wedging action to secure the cutting inserts into the grooves. For example, truncated V-shaped grooves may be used to receive an insert having a bottom surface with rear and front edges, and rear and front walls extending outwardly at diverging angles from the rear and front edges of the bottom surface to the body outer surface. The angle between the bottom surface and rear wall will normally be equal to the angle between the bottom surface and the front wall.

Attachment means is provided for removably securing the cutting insert into the groove. The attachment means may include a plurality of threaded apertures spaced, e.g., one inch apart, along the bottom surface of each of the grooves. The cutting inserts have apertures extending through the insert body. Fasteners extend through the insert body and engage the cutterhead apertures to secure the insert to the body.

In the preferred embodiment, the cutting insert is comprised of a blade holder having a chip-turning front shoulder preferably adapted to project slightly above the cutterhead body surface when the insert is secured in the groove, and detachable cutting blades mechanically secured into the holder behind the front shoulder. Each blade has a cutting edge projecting above the holder and the front shoulder. An attachment means secures the blades into the holder. The attachment means may include a blade attachment plate integrally formed with the insert body, with a slot behind the chip-turning shoulder to received the blades. Preferably, the blade holder is comprised of an insert body and at least one separate blade attachment gib, with the upper part of the blade attachment gib forming the front shoulder. In this structure, the blades are sandwiched between the blade attachment gib and the insert body.

The insert body is generally formed of a solid metal piece having top and bottom surfaces and side walls, and an angular front blade attachment wall. A blade support ledge, integral with the insert body, projects forward from the lower part of the body below the blade attachment wall, and includes a top surface and an angled front wall.

The top surface of the body is generally planar with a front edge and a rear edge. A gullet along the rear edge aids in removing chips before they reach the next cutting blade. The bottom surface of the body is generally beneath and parallel to the top surface and has a rear edge and a front edge. The outwardly angled rear wall extends upwardly from the rear edge of the bottom surface to the rear edge of the top surface.

The blade attachment gib used to secure the blades to the insert body is disposed in front of the blade. The blade attachment gib has an upper edge adapted to project above the cylindrical body surface when the cutting insert is secured in the receiving groove, a lower edge adapted to locate immediately adjacent to the blade support ledge, a rear face adapted to mate against the front face of the blade, and a front face adapted to be positioned against the front wall of the cutterhead body groove. The gib may have an attachment opening extending from the front face to the rear face for use in attaching the blade. Preferably, the blade attachment gib is separate from the insert body, which facilitates manufacturing and permits the use of different materials in the manufacture of the body and the gib.

Also, in the preferred embodiment, at least two detachable blades are secured between the blade attachment gib and the blade attachment wall. Alternately, a longer single blade may be provided instead of two separate blades. The blades, which will normally be formed of high speed steel or other hard material such as carbide, each have a rear face, a front face, an angular, upper edge extending above the top surface of the insert body, and a lower edge adapted to rest on the blade support ledge. Each blade may include attachment openings extending from its front face to its rear face. While the individual blades illustrated in the preferred embodiment of the invention each have a continuous-type cutting edge, it will be apparent that other shapes, such as those illustrated in the above Stewart patent can also be used.

First attachment means are used to secure the blades to the insert body between the blade attachment gib and the blade attachment wall. The first attachment means may be threaded fasteners such as bolts that extend through openings in the blade attachment gib and blades and into threaded recesses in the insert body. The heads of these fasteners are recessed into the attachment gib so that they do not project beyond the gib front face. Also, second attachment means are used to secure the entire cutting insert into the cutterhead body groove. These second attachment means may also be threaded fasteners such as bolts that extend through openings in the insert body and into threaded recesses at the bottom of the groove. The heads of these fasteners will be recessed into the insert body, so that they do not project above the top surface of the insert body.

The cutting insert is assembled by placing the blades against the blade attachment wall of the body insert with the lower edges of the blades resting on the ledge. The blade attachment gib is then positioned in front of the blades. Fasteners are then inserted through apertures in the plate and blades and threaded into apertures in the insert body. When tightened, the fasteners will be recessed into the blade attachment gib.

The assembled cutting insert is then placed in a groove of the cutterhead body, and other fasteners are inserted through apertures in the insert body and into threaded apertures in the cutterhead body at the bottom of the groove. When inserted in the groove, the cutting tips of the blades will project above the surface of the cutterhead body surface. Also, the upper edge or shoulder of the blade attachment gib will preferably project above the cutterhead body surface in front of the blades. When the cutting insert is secured in the cutterhead groove, the front wall of the blade attachment gib preferably contacts the groove and is wedged against the front wall of the groove. As a result, the blades are secondarily clamped by this wedging action so that the fasteners holding the gib and blades to the insert body cannot loosen. Thus, the blades are held tightly in position during use of the cutterhead.

During use, the cutting edge of each blade removes a chip from the workpiece. The chip is directed from the cutting edge to the upper edge or shoulder of the blade attachment gib which, in cooperation with the gullet of the adjacent insert, turns the chip.

When replacement of a blade is desired, the insert is removed from the cutterhead groove by removing the threaded fasteners holding the insert to the cutterhead body and the fasteners holding the gib and the blades to the insert body. The old blade can be removed, and a new blade inserted in its place.

Accordingly, one aspect of the present invention is to provide a removable cutting insert for use in a cutterhead for an industrial woodworking machine, the cutterhead including a generally cylindrical body having an outer surface, an insert-receiving groove extending into the cutterhead body from the outer surface, and means for removably securing the cutting insert in the groove, the cutting insert including: (a) a blade holder having a front shoulder; and (b) at least one detachable blade secured into the holder behind the front shoulder, the blade having a cutting edge projecting above the holder and the front shoulder.

Another aspect of the present invention is to provide a removable cutting insert for use in a cutterhead for an industrial woodworking machine, the cutterhead including a generally cylindrical body having an outer surface and an insert-receiving groove extending into the cutterhead body from the outer surface, and means for removably securing the cutting insert in the groove, the cutting insert including: (a) an insert body having a front wall; (b) at least one blade attachment gib positioned in front of the insert body front wall; (c) at least one detachable blade secured to the front wall behind the blade attachment gib, the blade having an upper edge projecting above the insert body and the blade attachment gib when the insert is secured in the blade receiving groove; and (d) attachment means for securing the blade between the blade attachment gib and the front wall.

Another aspect of the present invention is to provide a removable cutting insert for use in a cutterhead for an industrial woodworking machine, the cutterhead including a body having a cylindrical outer surface and an insert-receiving groove extending into the cutterhead body from the surface, the groove having a bottom surface and rear and front walls extending outwardly from bottom surface, the cutting insert including: (a) an insert body having a top surface with a front and rear edges, a bottom surface having rear and front edges spaced beneath and substantially parallel to the top surface, a gullet having a front edge integral with the rear edge of the top surface and a rear edge, an outwardly angled rear wall having an upper edge integral with the rear edge of the gullet and a lower edge integral with the rear edge of the bottom surface, an outwardly angled front wall having a top edge integral with the front edge of the top surface and a bottom edge below the top surface, and a blade support ledge extending forward from the front wall, the front wall having an aperture therein; (b) at least one detachable blade having a rear face secured to the insert body front wall, a front face, an angular upper edge projecting above the top surface of the insert body and the cutterhead body surface when the insert is secured in the insert-receiving groove, and a lower edge supported on the blade support ledge, the blade having an aperture extending therethrough; (c) at least one blade attachment gib secured in front of the blade, a lower edge adjacent to the blade support edge, a rear face mating against the front face of the blade, and a front face adapted to be positioned against the front wall of the cutterhead body groove, the gib having an aperture therethrough; and (d) a fastener projecting through the apertures in the blade attachment gib and blades and into the apertures in the insert body.

Another aspect of the present invention is to provide a cutterhead including: (a) a cutterhead body having an outer surface, an insert-receiving groove extending into the cutterhead body from the outer surface, and means for removably securing a cutting insert in the groove; (b) a removable cutting insert having a blade holder and at least one detachable blade secured into the holder behind the front shoulder, the blade having a cutting edge projecting above the holder and the front shoulder.

Still another aspect of the present invention is to provide a cutterhead for an industrial woodworking machine including: (a) a cutterhead body having a cylindrical outer surface and at least one insert-receiving groove extending into the body from the outer surface; (b) at least one cutting insert secured in the groove, the insert being comprised of an insert body having a front wall, at least one blade attachment gib positioned in front of the front wall and projecting above the outer surface, and at least one detachable blade secured behind the blade attachment gib and projecting above the insert body and the blade attachment gib; and (c) first attachment means securing the blade behind the blade attachment gib; and (d) second attachment means securing the insert in the groove.

These and other aspects of the present invention will be more clearly understood after review of the following description of the preferred embodiment of the invention when considered with the drawings.

DESCRIPTION OF THE PREFERRED EMBODIMENTS

Figure 1:
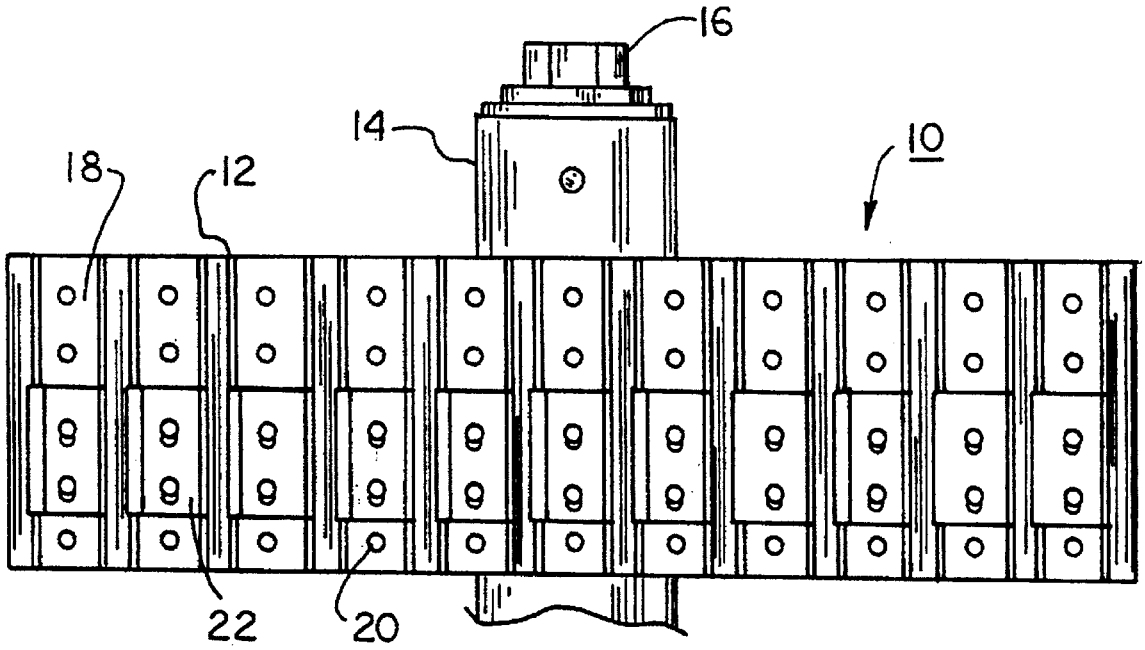
FIG. 1 is a top view of a cutterhead constructed according to the present invention.

Referring now to the drawings in general, it will be understood that the illustrations are for the purpose of describing a preferred embodiment of the invention and are not intended to limit the invention thereto.

As best seen in FIG. 1, a cutterhead, generally designated 10, is shown constructed according to the present invention. The cutterhead includes a cylindrical cutterhead body 12. The overall dimensions of body 12 typically will have a diameter of between about five and fifteen inches and a length of between about two and twenty inches, but the actual dimensions are dependent on the requirements of the individual wood working machine. In the preferred embodiment, body 12 is formed from a cylinder of alloy steel.

Body 12 is attached to a high speed planer (not shown) by means of a rotary shaft 14. A locking means 16, such as a keyed taper shaft and locking nut assembly, secures body 12 to shaft 14. Longer cutterheads may have the shaft built into the cutterhead. Body 12 contains a plurality of truncated V-shaped grooves 18 around its periphery. Each of the plurality of grooves 18 includes a plurality of threaded apertures 20 generally arranged along the bottom surface of each of the grooves 18. In the preferred embodiment, the apertures 20 are spaced about one inch apart.

Figure 2:
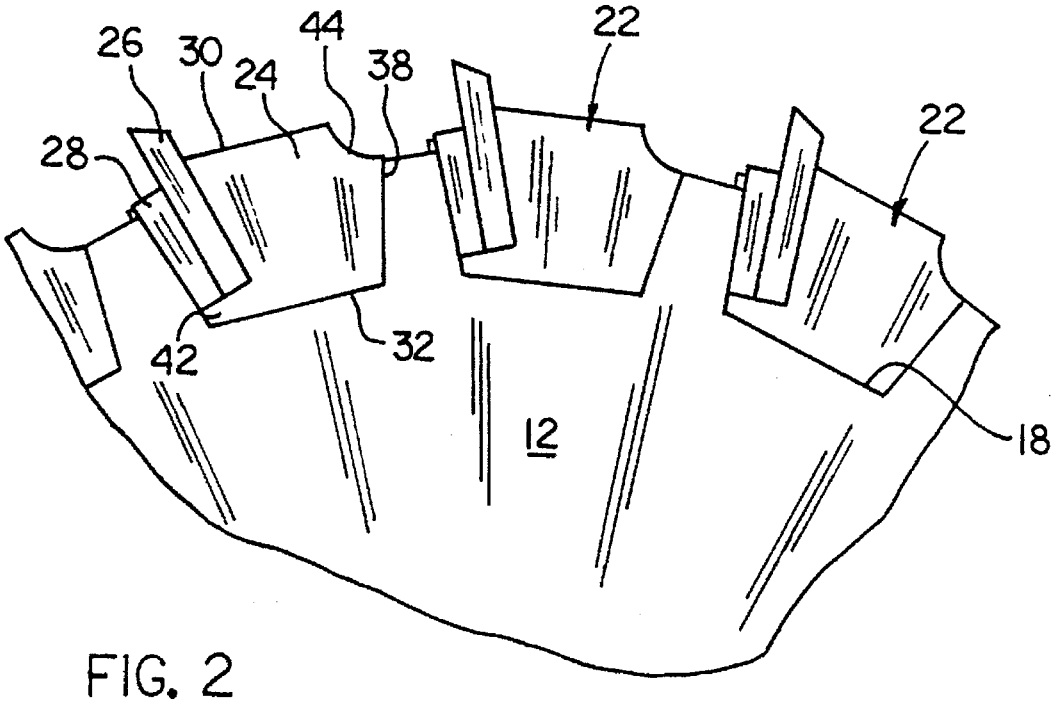
FIG. 2 is an enlarged, partial end view of the cutterhead of FIG. 1.
Figure 3:
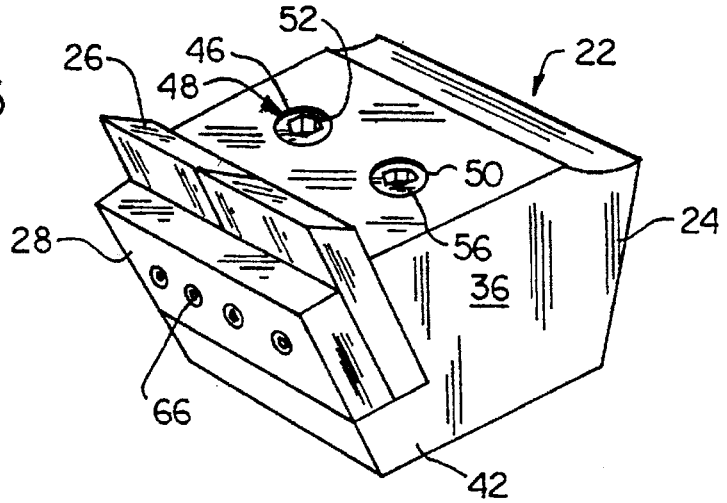
FIG. 3 is a perspective view of the cutting insert of the present invention.
Figure 4:
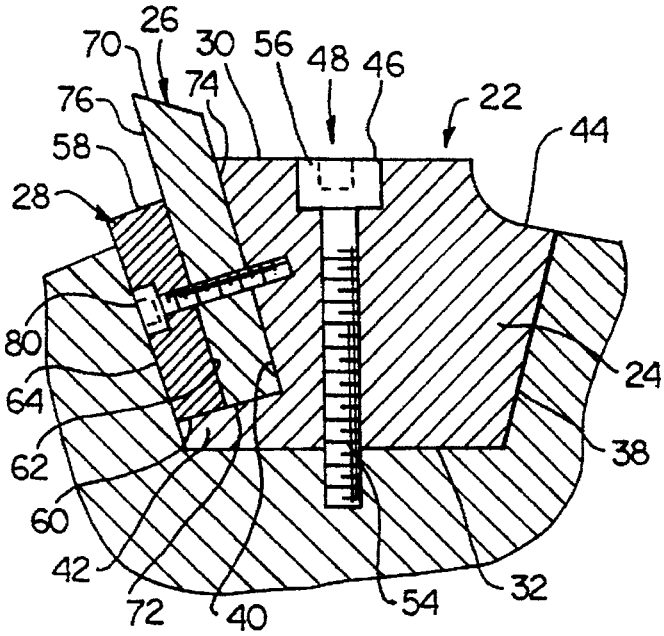
FIG. 4 is an cross-sectional end view of the cutting insert shown, in FIG. 3.
Figure 5:
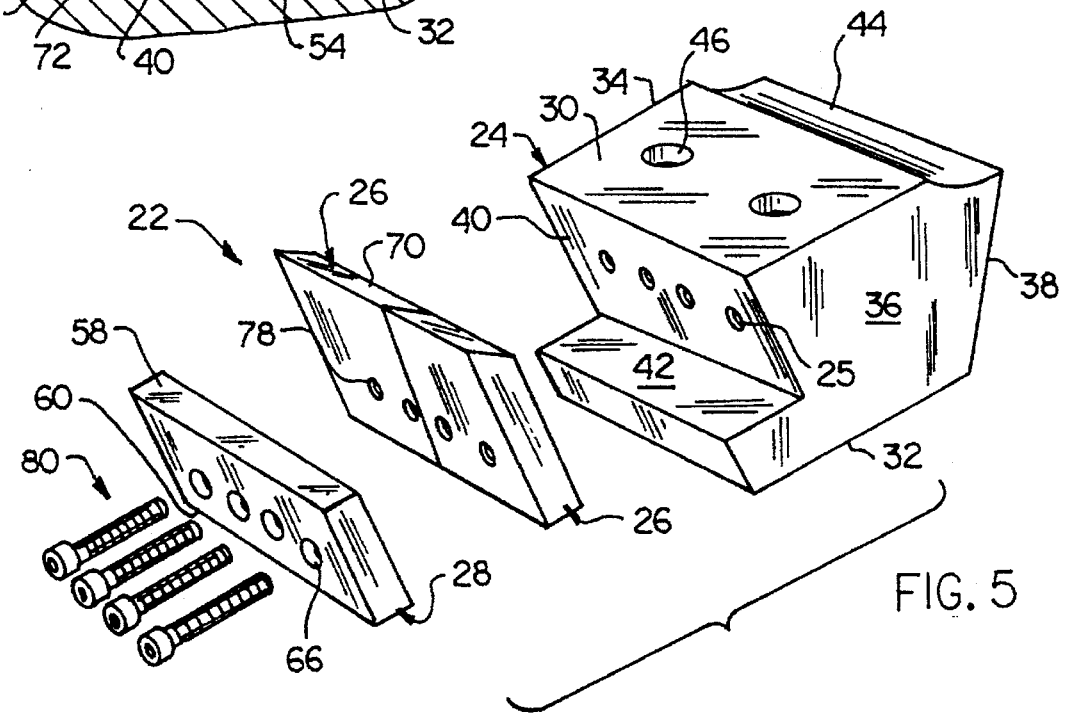
FIG. 5 is an exploded, perspective view of the cutting insert of FIG. 3.

Grooves 18 are shaped to receive a plurality of individual cutting inserts, generally 22. As best seen in FIGS. 3–5, each cutting insert 22 is comprised of an insert body 24, detachable blades 26, and a blade attachment gib 28. As best seen in FIG. 2, cutting inserts 22 mate with grooves 18. Insert body 24 is generally formed of a solid metal piece having a top surface 30, a bottom surface 32, side walls 34 and 36, a rear wall 38 and an angular front blade attachment wall 40. A blade support ledge 42 projects forward from the lower part of body 24 below blade attachment wall 40.

Top surface 30 of body 24 is generally planar with a gullet 44 along its rear edge to receive, and aid in turning, chips. Bottom surface 32 is generally below, and parallel to, top surface 30. Outwardly angled rear wall 38 extends upwardly from the rear edge of bottom surface 32 to the rear edge of the top surface 30.

Cutting insert 22 preferably includes a pair of counterbored and slotted apertures 46 for receiving attachment means 48. Each aperture 46 includes a contact shoulder portion 50 and a slot portion 52. Preferably, apertures 46 are equally spaced from the longitudinal ends of the cutting inserts 22 and one another, thereby distributing the load of the attachment means 48. Also, in the preferred embodiment, attachment means or fastener 48 is a threaded fastener having a threaded body 54 and an enlarged cap 56 adapted to contact shoulder 50. Flat washers (not shown) may be located between the enlarged cap 56 and the contact shoulder portion 50.

Each of the apertures 46, shoulder portion 50, and slot portion 52 are adapted to receive fasteners 48 while, at the same time, permitting each of the fasteners 48 to move laterally along the horizontal axis of the cutting inserts 22 within each of the apertures 46. This construction permits lateral movement of the cutting inserts 22, thereby facilitating the adjustment of profile shapes required at initial setup or after reworking, regrinding, etc.

Cutting inserts 22 preferably are approximately two inches in overall length so that material surfaces up to two inches in width can be surfaced with only one insert per row. Cutting inserts 22 may be abutted together to produce increases in cutting widths in two inch increments, thereby reducing the number of cutterheads 10 required for high speed machines producing more than one product.

Blade attachment gib 28, used to secure blade 26 to insert body 24, has an upper edge 58 preferably adapted to project above the surface of cutterhead body 12 when insert 22 is secured in insert-receiving groove 18, a lower edge 60 adapted to locate immediately adjacent or rest on the blade support ledge 42, a rear face 62, and a front face 64 adapted to be positioned against the front wall of cutterhead body groove 18. Gib 28 includes apertures 66 extending from front face 64 to rear face 62, which are used in attaching blade 26.

Each detachable blade 26, secured between blade attachment wall 40 and gib 28, has an angular, upper edge 70 extending above top surface 30 of insert body 22, a lower edge 72 adapted to rest on blade support ledge 42, a rear face 74, and a front face 76. Each blade 26 includes apertures 78 extending from front face 76 to rear face 74. As shown in the drawings, the preferred embodiment of the cutting insert 22 includes two separate blades 26 disposed side-by-side between the gib 28 and the blade attachment wall 40. Alternately, a single longer blade can be provided, which extends across substantially the entire width of the cutting insert 22.

Attachment means or fasteners 80 extend through apertures 78 and 66 and into threaded recesses 25 in insert body 24 to secure blades 26 between blade attachment gib 28 and blade attachment wall 40. Fasteners 80 are recessed into attachment gib 28 so that they do not project beyond the front face 64 thereof.

Certain modifications and improvements will occur to those skilled in the art upon reading of the foregoing description. By way of example, the overall shape of the cutting inserts can be modified to fit into cutterhead bodies other than the type specifically described. Also, the blade support ledge can be formed as a part of the blade attachment gib instead of the insert body or, for some applications, eliminated entirely. In addition, either two short or one long blade can be provided. Likewise, the gib could also be either one long gib as shown or two short gibs, one for each of two blades. It should be understood that all such modifications and improvements have been deleted herein for the sake of conciseness and readability but are properly within the scope of the following claims.

I claim:

1. A removable cutting insert for use in a cutterhead for an industrial woodworkng machine, said cutterhead including a generally cylindrical body having an outer surface, an insert-receiving groove extending into said cutterhead body from the outer surface, and means for removably securing said cutting insert in said groove, said cutting insert comprising:

(a) a blade holder having a front blade attachment wall; and (b) at least one detachable blade secured into said holder adjacent said front blade attachment wall, said blade having a cutting edge projecting above said holder and said front blade attachment wall, wherein said blade holder is comprised of an insert body and at least one blade attachment gib, said blade being secured between said body and said gib.

2. The cutting insert of claim 1, further including attachment means for securing said blade into said holder.

3. The cutting insert of claim 1, wherein said blade holder includes a blade support ledge below said blade.

4. The cutting insert of claim 1, wherein said groove and said holder have corresponding, outwardly projecting walls.

5. The cutting insert of claim 1, wherein said front blade attachment wall of said blade holder is adapted to project above said cutterhead body surface when said insert is secured in said groove.

6. The cutting insert of claim 1, wherein there are at least two detachable blades secured side-by-side in said holder adjacent said front blade attachment wall.

7. A removable cutting insert for use in a cutterhead for an industrial woodworking machine, said cutterhead including a generally cylindrical body having an outer surface and an insert-receiving groove extending into said cutterhead body from the outer surface, and means for removably securing said cutting insert in said groove, said cutting insert comprising:

(a) an insert body having a front wall;

(b) at least one blade attachment gib positioned adjacent said insert body front wall;

(c) at least one detachable blade secured to said front wall adjacent said blade attachment gib, said blade having an upper edge projecting above said insert body and said blade attachment gib when said insert is secured in said blade receiving groove; and (d) attachment means for securing said blade between said blade attachment gib and said front wall.

8. The cutting insert of claim 7, wherein said insert body includes a forward projecting ledge beneath said blade.

9. The cutting insert of claim 7, wherein said insert body comprised a top surface, a bottom surface below and parallel to said top surface, outwardly projecting rear and front walls extending from said bottom surface to said top surface, said rear and front walls being joined to said bottom surface at approximately equal angles.

10. The cutting insert of claim 7, wherein said insert body, said blade and said gib include corresponding apertures, and said attachment means is comprised of fasteners extending though said blade and gib apertures and into said insert body apertures.

11. The cutting insert of claim 10, wherein said fasteners include a threaded body and a head, said head being recessed into said gib when said gib and blade are secured to said body.

12. The cutting insert of claim 7, wherein said gib includes an upper edge adapted to project above said cylindrical body surface when said insert is secured in said blade receiving groove.

13. The cutting insert of claim 7, wherein there are at least two detachable blades secured side-by-side to said front wall adjacent said blade attachment gib.

14. A removable cutting insert for use in a cutterhead for an industrial woodworking machine, said cutterhead including a body having a cylindrical outer surface and an insert-receiving groove extending into said cutterhead body from said surface, said groove having a bottom surface and rear and front walls extending outwardly from bottom surface, said cutting insert comprising:

(a) an insert body having a top surface with front and rear edges, a bottom surface having rear and front edges spaced beneath and substantially parallel to said top surface, a gullet having a front edge integral with the rear edge of said top surface and a rear edge, an outwardly angled rear wall having an upper edge integral with the rear edge of said gullet and a lower edge integral with the rear edge of said bottom surface, an outwardly angled front wall having a top edge integral with the front edge of said top surface and a bottom edge below said top surface, and a blade support ledge extending forward from said front wall, said front wall having an aperture therein;

(b) at least one detachable blade having a rear face secured to said insert body front wall, a front face, an angular upper edge projecting above the top surface of said insert body and said cutterhead body surface when said insert is secured in said insert-receiving groove, and a lower edge supported on said blade support ledge, said blade having an aperture extending therethrough;

(c) at least one blade attachment gib secured adjacent said blade, said gib having an upper end, a lower edge adjacent to said blade support ledge, a rear face mating against the front face of said blade, and a front face adapted to be positioned against the front wall of said cutterhead body groove, said gib having an aperture therethrough; and (d) a fastener projecting through the apertures in said blade and blade attachment gib and into the apertures in said insert body.

15. The cutting insert of claim 14, wherein said upper edge of said gib projects above said cutterhead surface when said insert is secured in said blade receiving groove.

16. The cutting insert of claim 14, wherein there are at least two detachable blades secured side-by-side to said insert body front wall.

17. A cutterhead comprising:

(a) a cutterhead body having an outer surface, an insert-receiving groove extending into said cutterhead body from said outer surface, and means for removably securing a cutting insert in said groove;

(b) a removable cutting insert having a blade holder with a front blade attachment wall; and at least one detachable blade secured into said holder adjacent said front blade attachment wall, said blade having a cutting edge projecting above said holder and said front blade attachment wall, wherein said blade holder is comprised of an insert body and at least one blade attachment gib, said blade being secured between said body and said gib.

18. The cutterhead of claim 17, further including first attachment means for securing said blade into said holder, and second attachment means for securing said insert in said groove.

19. The cutterhead of claim 17, wherein said blade holder includes a blade support ledge below said blade.

20. The cutterhead of claim 17, wherein said groove and said holder have corresponding, outwardly projecting walls.

21. The cutterhead of claim 17, wherein said front shoulder of said blade holder is adapted to project above said cutterhead body outer surface when said insert is secured in said groove.

22. The cutterhead of claim 17, wherein there are at least two detachable blades secured side-by-side into said holder.

23. A cutterhead for an industrial woodworking machine comprising:

(a) a cutterhead body having a cylindrical outer surface and at least one insert-receiving groove extending into said body from said outer surface;

(b) at least one cutting insert secured in said groove, said insert being comprised of an insert body having a first wall, at least one blade attachment gib positioned adjacent said first wall, and at least one detachable blade secured adjacent said blade attachment gib and projecting above said insert body and said blade attachment gib; and (c) first attachment means securing said blade adjacent said blade attachment gib; and (d) second attachment means securing said insert in said groove.

24. The cutterhead of claim 23, wherein said insert body includes a forward projecting ledge beneath said blade and said attachment gib.

25. The cutterhead of claim 23, wherein said insert body and said groove include corresponding, outwardly projecting rear and front walls.

26. The cutterhead of claim 23, wherein said insert body, said blade, and said gib include corresponding apertures, and said first attachment means is comprised of fasteners extending through said blade and gib apertures and into said insert body apertures, said fasteners including a threaded body and a head recessed into said gib.

27. The cutterhead of claim 23, wherein said blade attachment gib projects above said cylindrical outer surface.

28. The cutterhead of claim 23, wherein there are at least two detachable blades secured side-by-side adjacent said blade attachment gib.

* * * * *